US008919615B2

(12) United States Patent
Szekely

(10) Patent No.: US 8,919,615 B2
(45) Date of Patent: Dec. 30, 2014

(54) LIQUID DOSING DISPENSER

(75) Inventor: Alex S. Szekely, Jackson, NJ (US)

(73) Assignee: Plastek Industries, Inc., Erie, PA (US)

( * ) Notice: Subject to any disclaimer, the term of this patent is extended or adjusted under 35 U.S.C. 154(b) by 0 days.

(21) Appl. No.: 13/823,777

(22) PCT Filed: Jan. 19, 2012

(86) PCT No.: PCT/US2012/021823

§ 371 (c)(1),
(2), (4) Date: Mar. 15, 2013

(87) PCT Pub. No.: WO2012/100021

PCT Pub. Date: Jul. 26, 2012

(65) Prior Publication Data

US 2013/0284765 A1 Oct. 31, 2013

Related U.S. Application Data

(60) Provisional application No. 61/434,507, filed on Jan. 20, 2011.

(51) Int. Cl.

| | |
|---|---|
| ***B65D 88/54*** | (2006.01) |
| ***G01F 11/00*** | (2006.01) |
| ***B65D 37/00*** | (2006.01) |
| ***G01F 11/28*** | (2006.01) |
| ***B65D 47/20*** | (2006.01) |
| ***B65D 47/24*** | (2006.01) |
| ***B65D 35/40*** | (2006.01) |
| ***A47K 5/12*** | (2006.01) |

(52) U.S. Cl.

CPC ..... *B65D 47/2068* (2013.01); *B65D 47/242* (2013.01); *B65D 35/40* (2013.01); *A47K 5/1201* (2013.01); *A47K 5/1202* (2013.01)

USPC ..... 222/322

(58) Field of Classification Search

CPC ..... B65D 41/26; B65D 41/265; B65D 34/40; B65D 47/123; B65D 47/241; B65D 47/242; B65D 47/243; B65D 47/248; G01F 11/10; G01F 11/12; G01F 11/20; G01F 11/22; G01F 11/26; G01F 11/262; G01F 11/263; G01F 11/265

USPC ..... 222/212, 207, 322, 444, 445, 446, 448, 222/449, 450, 205, 454, 501, 318; 141/274, 141/296

See application file for complete search history.

(56) References Cited

U.S. PATENT DOCUMENTS 1,283,050 A * 10/1918 Berg ..... 222/322
3,179,300 A 4/1965 Davidson et al.

(Continued)

FOREIGN PATENT DOCUMENTS

RU 2225818 C2 3/2004

OTHER PUBLICATIONS

International Search Report and Written Opinion for PCT/US2012/021823, dated Apr. 20, 2012.

(Continued)

*Primary Examiner* — J. Casimer Jacyna
*Assistant Examiner* — Benjamin R Shaw
(74) *Attorney, Agent, or Firm* — Bachman & LaPointe P.C.

(57) ABSTRACT

A dispenser (20) has a container body (22), a closure valve assembly (24), and a cap. The closure valve assembly has: a seat (100) having an opening (122); a valve element (90); and a plurality of radially inwardly directed petals (106). The valve element is shiftable between: an open position depressed clear of the opening; and a closed position closing the opening. The petals support the valve element with flex spring bias toward the closed position. The cap has: a closed condition depressing the valve element to the valve element's open position; and an open condition disengaged from the valve element.

20 Claims, 11 Drawing Sheets

(56) References Cited

U.S. PATENT DOCUMENTS

| | | | | |
|---|---|---|---|---|
| 4,376,495 | A * | 3/1983 | Spatz | 222/46 |
| 4,875,603 | A | 10/1989 | Weinstein | |
| 4,951,839 | A * | 8/1990 | Kong | 222/47 |
| 5,743,437 | A * | 4/1998 | Moore et al. | 222/147 |
| 5,967,377 | A | 10/1999 | Glynn | |
| 6,068,165 | A * | 5/2000 | Minihane et al. | 222/454 |
| 6,334,551 | B1 | 1/2002 | Taghavi-Khanghah | |
| 8,262,592 | B1 * | 9/2012 | Brooks et al. | 601/17 |
| 2011/0079613 | A1 * | 4/2011 | Chih | 222/158 |

OTHER PUBLICATIONS

International Preliminary Report on Patentability for PCT/US2012/021823, dated Jul. 23, 2013.

* cited by examiner

LIQUID DOSING DISPENSER

CROSS-REFERENCE TO RELATED APPLICATION

Benefit is claimed of U.S. patent application Ser. No. 61/434,507, filed Jan. 20, 2011, and entitled "Liquid Dosing Dispenser", the disclosure of which is incorporated by reference herein in its entirety as if set forth at length.

BACKGROUND OF THE INVENTION

The invention relates to dispensing of household liquids. More particularly, the invention relates to dosing dispensers for liquids such as laundry detergent and the like.

When dispensing household liquids, it is often desired to be able to dispense a predetermined dose. For example, the dose may represent the desired amount of laundry detergent for a typical load of laundry. A measuring cap with a drain-back spout is the current state of the art in liquid laundry detergent packaging.

SUMMARY OF THE INVENTION

One aspect of the invention involves a dispenser having a container body, a closure valve assembly, and a cap. The closure valve assembly has: a seat having an opening; a valve element; and a plurality of radially inwardly directed petals. The valve element is shiftable between: an open position depressed clear of the opening; and a closed position closing the opening. The petals support the valve element with flex spring bias toward the closed position. The cap has: a closed condition depressing the valve element to the valve element's open position; and an open condition disengaged from the valve element.

Other aspects involve use of the dispenser to dispense sequential doses of liquid.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
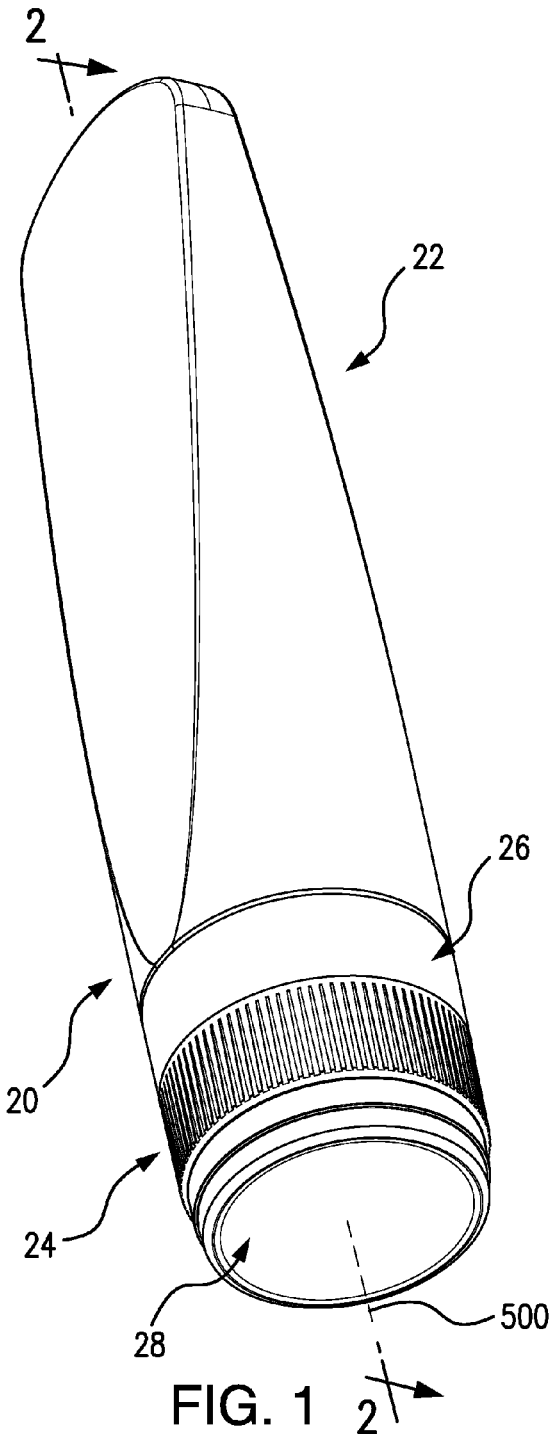
FIG. 1 is a view of a liquid dosing dispenser.
Figure 2:
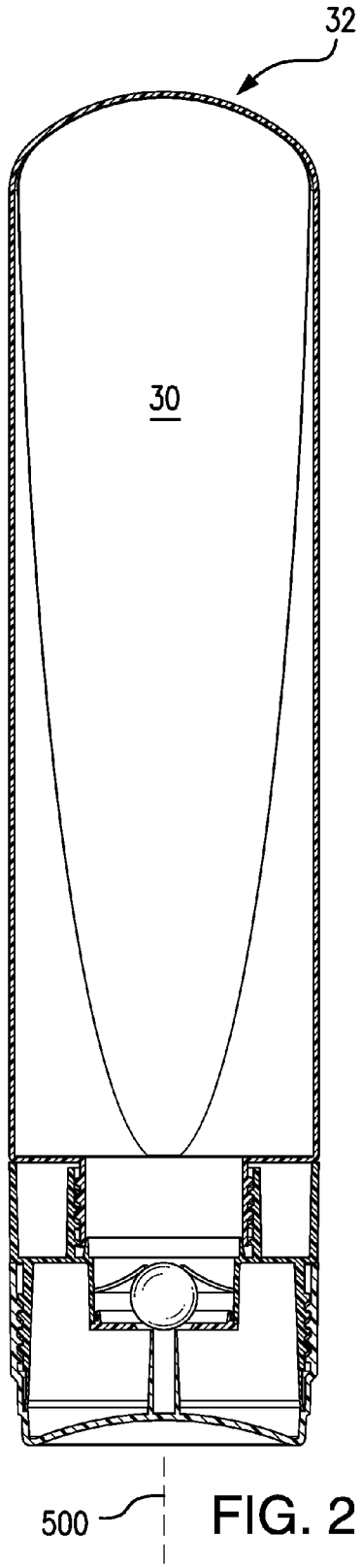
FIG. 2 is a longitudinal sectional view of the dispenser of FIG. 1, taken along line 2-2.
Figure 3:
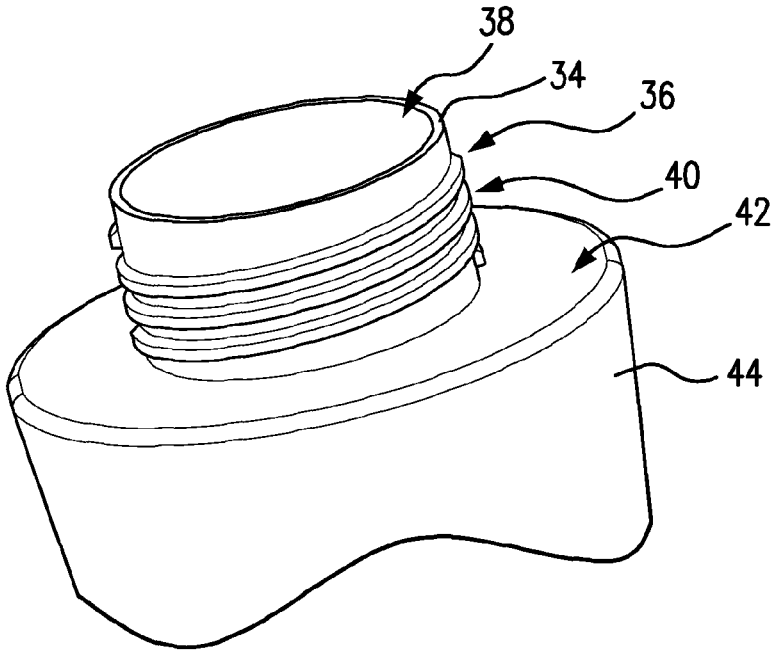
FIG. 3 is a cutaway view of the open end of a container body.

FIG. 1 shows a dispenser 20 having a container body 22 and a closure assembly 24. The exemplary closure assembly 24 comprises a valve assembly 26 mounted to the body 22 and a cap or cover 28 mounted to the valve assembly in at least a closed condition of the cap. The exemplary body 22 is formed of molded plastic (e.g., a blow molding of polypropylene, polyethylene, or polyethylene terepthalate (PET)) and has an interior 30 and extends from a closed first end 32 to a second end at a rim 34 (FIG. 3) of a neck 36. The rim bounds a mouth 38. The neck bears an external thread 40 (e.g., a double lead thread). The exemplary body has a shoulder 42 extending radially outward from a base of the neck and joining a sidewall 44. The exemplary valve assembly cap and container neck share a common central longitudinal axis 500 (FIGS. 1&2).

Figure 4:
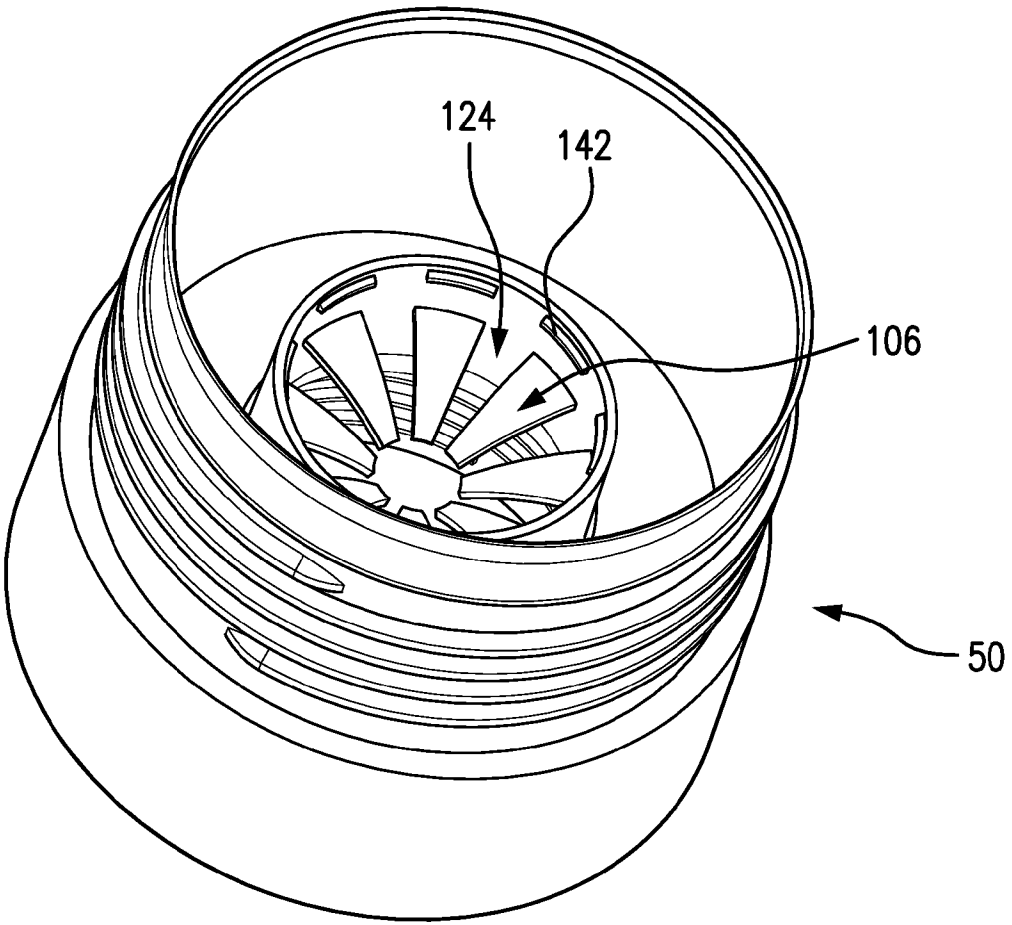
FIG. 4 is a view of a main body molding of the valve body.
Figure 5:
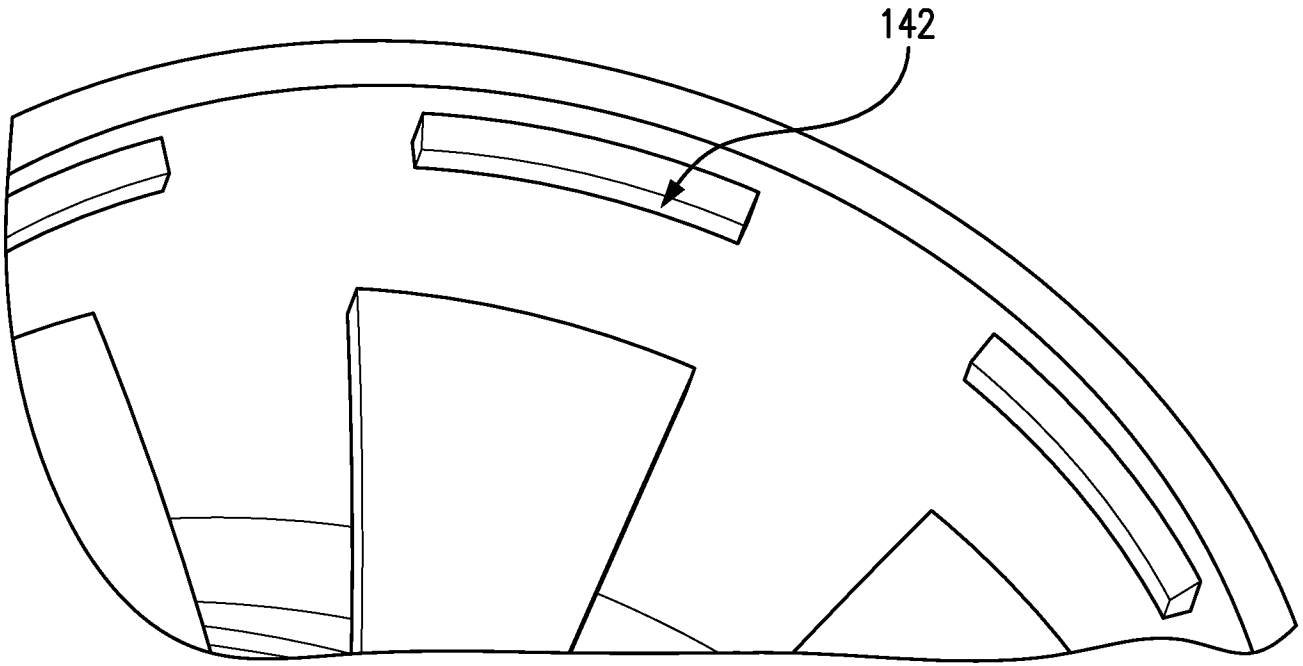
FIG. 5 is an enlarged view of the rim portion of an inner wall of the body of FIG. 4.

The exemplary valve assembly 26 comprises a valve main body 50 (FIGS. 4&5). The exemplary main body 50 is formed as a unitary single piece molding (e.g., an injection molding of polypropylene). The exemplary main body includes a proximal (e.g., near the location of the attachment to the container body 22) internally threaded boss 52 (FIG. 6) extending from a rim 54 and bearing an internal thread 56 (e.g., a double lead thread). In an installed condition, the boss receives the mouth of the container body with the internal thread 56 engaging the external thread 40. The exemplary main body has an annular transverse web 60 at an upper end 58 of the boss 52. Outboard (radially) and distally of the boss, an externally threaded neck 62 extends distally (axially opposite the boss 52) to a rim 64. The neck bears an external thread 66.

Figure 7:
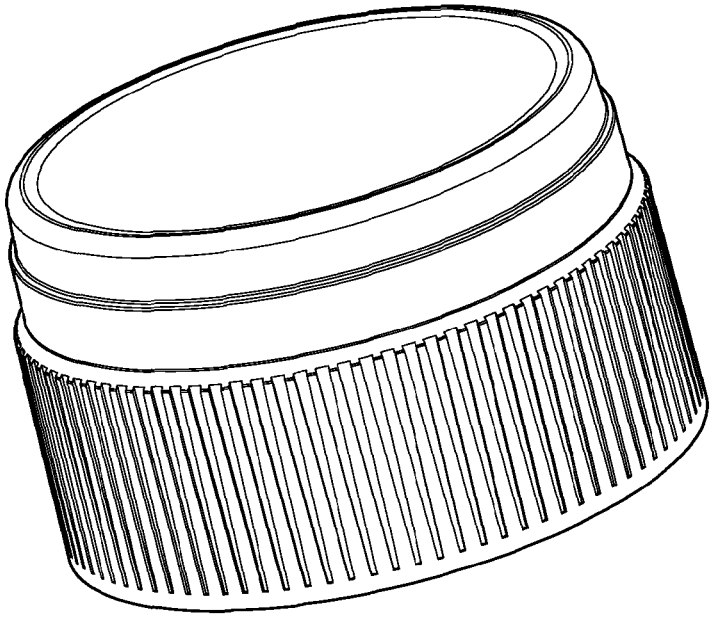
FIG. 7 is a first view of a cap of the dispenser.
Figure 8:
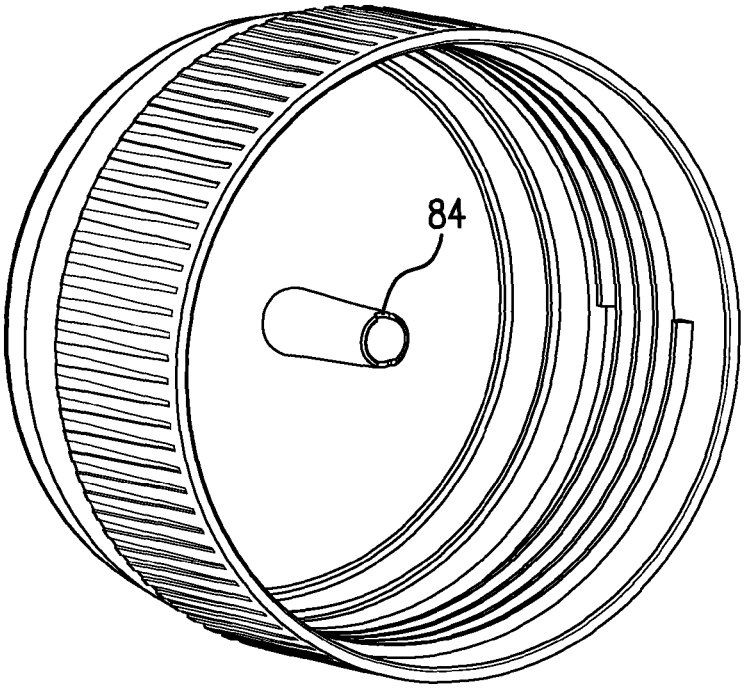
FIG. 8 is a second view of the cap.

The cap 28 (FIG. 6 and isolated in FIGS. 7&8) has an internally threaded sidewall 70 receiving the neck 62 and having an internal thread 72 engaged to the thread 66 in the cap's installed/closed condition. The sidewall 70 extends to a rim 74 at one axial end and to a junction of the periphery of a transverse web 78 at the other end. As is discussed further below, the exemplary transverse web 78 is longitudinally inwardly convex and outwardly concave for structural integrity. As is discussed further below, an annular boss 80 depends from the underside of the web 78 to a distal rim 82. The exemplary cap is formed as a unitary single piece molding (e.g., an injection molding of polypropylene). The exemplary rim 82 is castellated (e.g., via a pair of recesses 84). In the cap's installed condition, the rim 82 engages a valve element 90 (e.g., a spherical ball (e.g., also of a molded plastic such as polypropylene then spherically ground)). The recesses 84 serve to vent/drain the boss 80. If any liquid gets inside of the boss, upon uprighting the package the small opening provided by the recesses will allow the liquid to drain out and back around the ball into the body interior.

Figure 6:
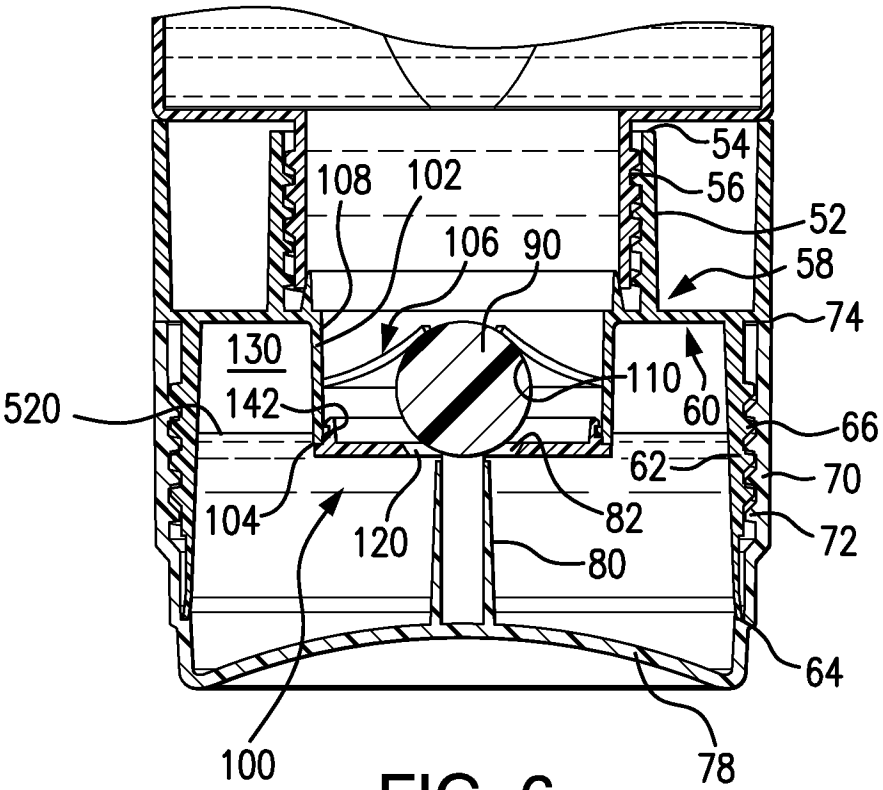
FIG. 6 is an enlarged view of the dispensing end of the dispenser of FIG. 2.
Figure 9:
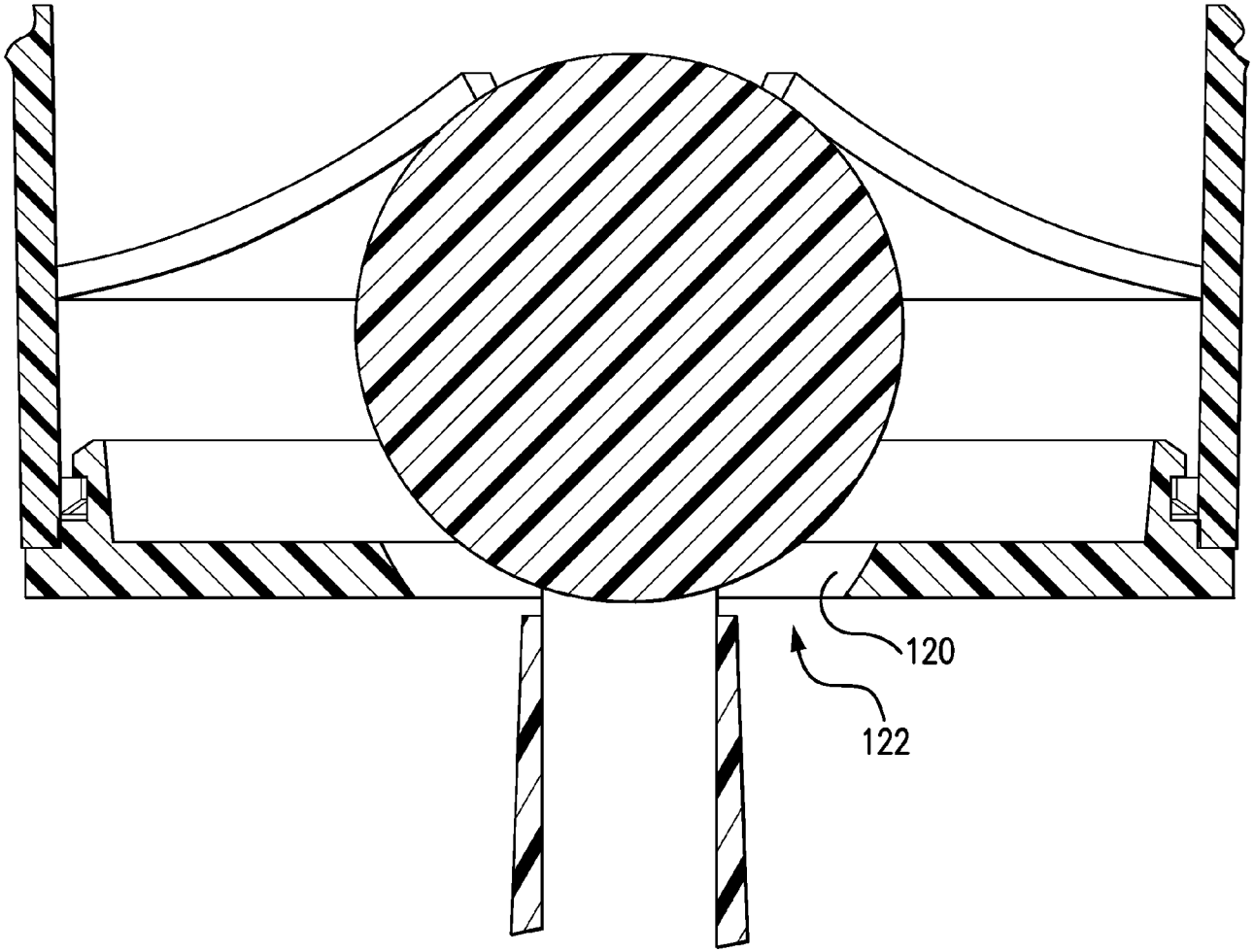
FIG. 9 is a further enlarged view of a ball area of the valve assembly of the dispenser of FIG. 2.

The ball 90 is retained in the valve body between the main body and a valve seat element 100 which combine to form a valve body assembly. To do this, the valve main body further includes an annular wall 102 extending distally from an inboard perimeter of the web 60 (e.g., axially opposite the boss 52 to a rim 104). A plurality of flex spring petals 106 extend radially inward from the inboard surface 108 of the wall 102 and are unitarily formed therewith as part of the molding. Axially outboard surface portions 110 of the petals contact and support the ball 90 to spring bias the ball axially outward (distally). With the cap in its FIG. 6 installed condition, the boss 80 counterbiases the petals to hold the ball in a first position (See, also FIG. 9). In the first position, the ball is held spaced apart from a seat surface 120 of the seat element 100. The exemplary seat surface 120 is a frustoconical surface defining an opening 122 (FIG. 9). In the ball's first position, it is spaced apart from the surface 120 so that an annular flowpath is provided between the ball and the seat surface 120. Gaps 124 (FIG. 4) between the petals allow fluid from the interior of the container body to flow around the ball and through the opening 122 into a space bounded by an annular channel 130 (FIG. 6) in the valve body and the adjacent portions of the cap interior surface. The exemplary channel 130 has an inboard wall formed by the wall 102, an outboard wall formed by the neck 62, and a base formed by the web 60. FIG. 6 schematically shows fluid having flowed into this space to a surface level shown as 520. Air pressure in the channel above this surface may prevent any further rise.

Figure 10:
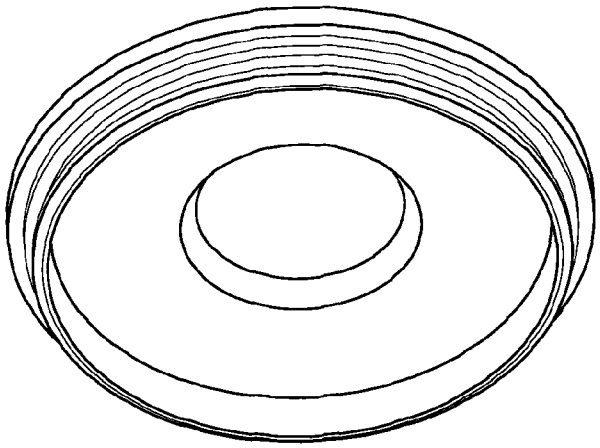
FIG. 10 is a view of a cover of the body of the valve assembly.
Figure 11:
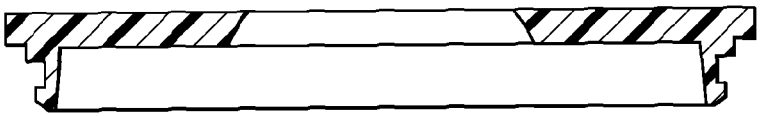
FIG. 11 is a central longitudinal sectional view of the cover of FIG. 10.

The exemplary valve seat element 100 is also formed as a plastic molding (e.g., injection molded polypropylene). It is secured across the distal end of the wall 102 via a snap fit (e.g., an annular outwardly-directed barb 140 (FIG. 6, See, also FIGS. 10&11) cooperating with a segmented inwardly directed barb 142 of the wall 102 (see also FIG. 5)). In the illustrated implementation, the barbs 142 are approximately radially coextensive and in phase with the roots of the petals 106. In alternative implementations, they may be otherwise (e.g., out of phase/inbetween).

Figure 12:
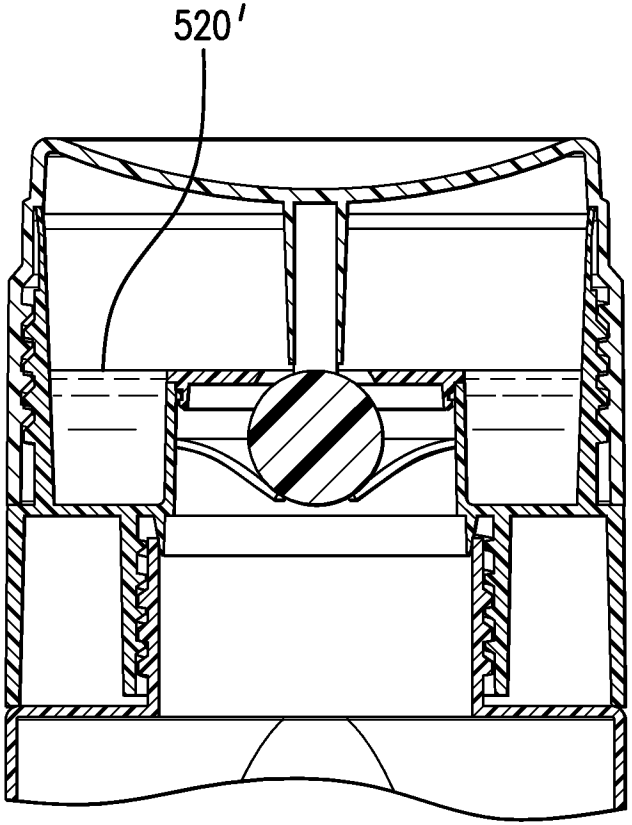
FIG. 12 is a view of the dispenser inverted relative to FIG. 6.
Figure 13:
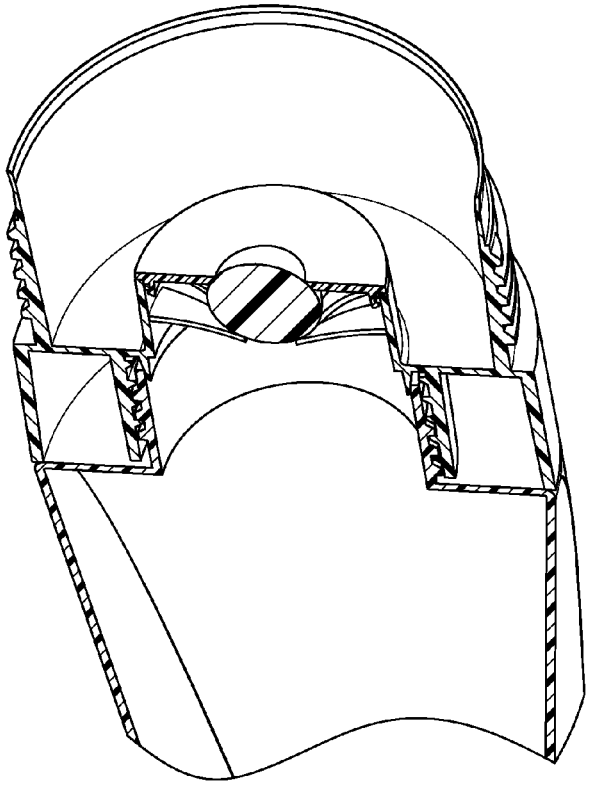
FIG. 13 is a partial cutaway view of the dispenser after cap removal.
Figure 14:
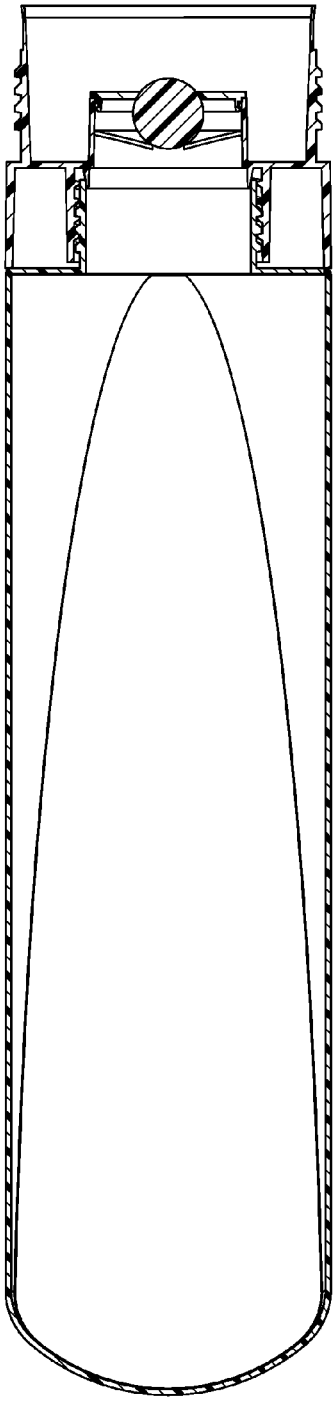
FIG. 14 is a longitudinal sectional view of the dispenser of FIG. 13.
Figure 15:
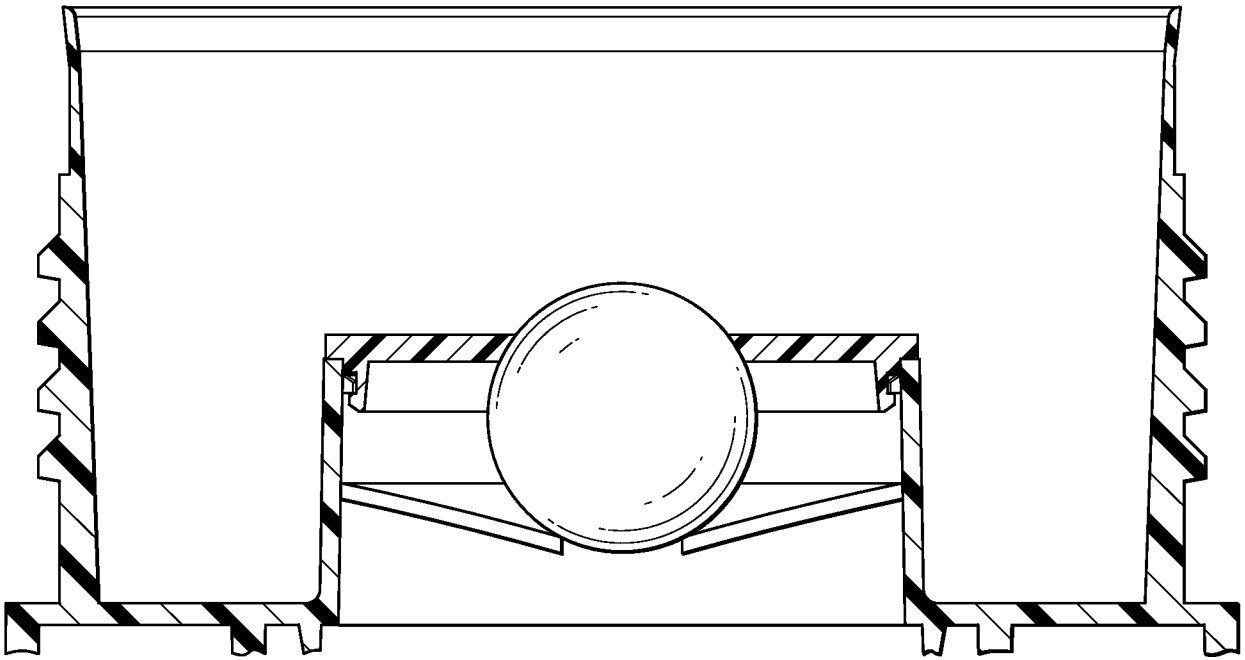
FIG. 15 is an enlarged view of the ball area of the valve element of the dispenser of FIG. 14.

When the bottle is inverted relative to the FIG. 6 orientation, the accumulated liquid will be captured in the annular channel 130 and have a surface 520' (FIG. 12). The channel and cap dimensions and valve element positions may be chosen to yield a desired volume of liquid left in the channel after inverting to the FIG. 12 orientation. This amount represents the desired dose of liquid. An exemplary dose of liquid is 10-70 milliliters, more narrowly, 20-70 milliliters or 20-50 milliliters. An exemplary total container capacity is 0.2-1.5 liter, more narrowly, 0.5-1.5 liter. From the FIG. 12 orientation, the cap may be unscrewed to an open condition/position disengaged from the valve element. As the cap is unscrewed, its boss 80 moves distally, allowing the ball to rise to a closed position of the ball engaging the seat surface 120 (FIGS. 13-15). This seals/closes the valve, allowing the accumulated dose to be poured out without further liquid escaping from the container interior. Thereafter, the cap may be reinstalled (e.g., via re-screwing). The re-installation re-depresses the ball, allowing a new dose to be introduced upon the next inversion cycle. The cap concavity helps maintain shape and resist deformation from engagement forces with the ball.

As noted above, the parts may be individually molded. In an exemplary dispenser assembly sequence, the valve main body is fixtured and the ball lowered into engagement with the petals. Thereafter, the seat element may be snap fit to the valve main body over the ball. Then, the cap may then be screwed on to the valve body (or this may occur after the valve body is screwed on to the container body).

Figure 16:
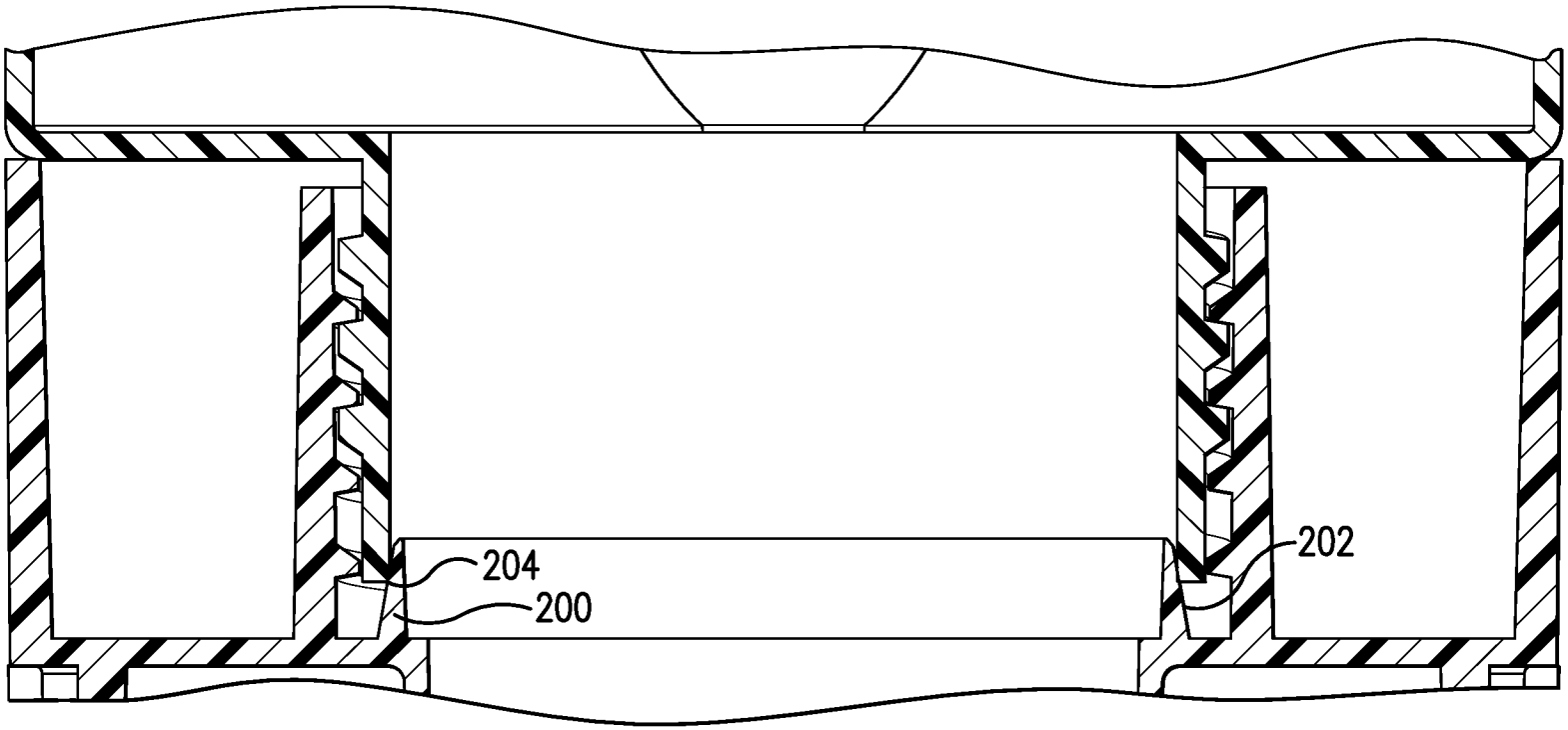
FIG. 16 is a view of a valve element-to-container body seal.
Figure 17:
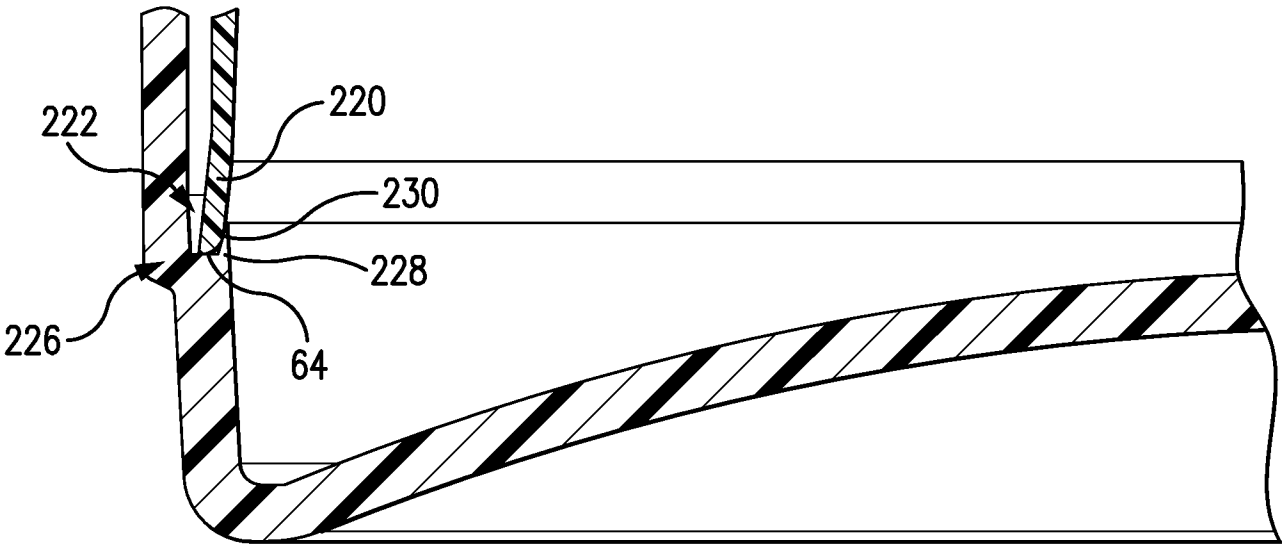
FIG. 17 is a view of a cap-to-valve body seal.

The exemplary embodiment includes additional sealing elements. These include a depending annular lip seal 200 (FIG. 16) of the valve main body which has a tapering outboard surface 202. The surface 202 engages the container body mouth along an interior perimeter 204 thereof. Additionally, the valve main body neck has a distal portion 220 (FIG. 17) beyond the exterior thread which forms a lip seal engaging a channel 222 in an internal shoulder 226 of the cap. An exemplary inboard wall of the channel 226 is formed by the outboard surface of an inboard lip 228 depending from the shoulder 226 and engaging an adjacent inboard surface portion 230 of the main body neck distal portion 220.

One or more embodiments of the present invention have been described. Nevertheless, it will be understood that various modifications may be made without departing from the spirit and scope of the invention. For example, the dose and liquid viscosity may influence various dimensions. Similarly, it may be desired to configure the overall exterior profile of the dispenser to resemble some existing dispenser or to have some desired ornamental appearance. Accordingly, other embodiments are within the scope of the following claims.

What is claimed is:

1. A dispenser (20) comprising:
a container body (22);
a closure valve assembly (24) comprising:
a seat (100) having an opening (122);
a valve element (90) shiftable between:
an open position depressed clear of the opening; and
a closed position closing the opening; and
a plurality of radially inwardly directed petals (106) supporting the valve element (90) with flex spring bias toward the closed position; and
a cap (28) having:
a closed condition depressing the valve element to the valve element's open position; and
an open condition disengaged from the valve element, wherein the closure valve assembly comprises a main body (50) as:
an internally threaded boss (52) receiving an externally threaded neck (36) of the container;
an externally threaded neck (62) received in an internally threaded sidewall (70) of the cap in the closed condition;
an annular wall (102) within the neck cooperating with the neck to define an annular channel; and
said plurality of petals (106) directed radially inward from the annular wall.

2. The dispenser of claim 1 wherein:
the valve element (90) is a spherical ball; and
the seat is formed as a cover secured to the main body to retain the ball.

3. The dispenser of claim 2 wherein:
the cover is snap fit across the annular wall.

4. The dispenser of claim 1 wherein:
the container body has a capacity of 0.3-1.5 liters.

5. The dispenser of claim 1 containing liquid in the container body.

6. The dispenser of claim 5 wherein:
the liquid is laundry detergent.

7. A method for using the dispenser of claim 1 comprising:
with the cap in its closed condition, orienting the dispenser so as to flow liquid from the container body through the seat opening;
moving the cap to its open condition so as to allow the valve element to shift under spring bias to its closed position, isolating a dose of the liquid; and
pouring the dose from the dispenser.

8. The method of claim 7 wherein:

the flow of liquid from the container body through the seat opening passes the liquid through gaps (124) between the petals.

9. The method of claim 7 further comprising:

between the orienting and the moving, reorienting the dispenser to a valve-up condition.

10. The method of claim 7 wherein:

the moving comprises unscrewing.

11. The method of claim 7 wherein:

the dose is 0.02-0.07 liter.

12. A method for manufacturing the dispenser (20) of claim 1, the method comprising:

molding a valve main body (50) of the closure valve assembly (24);

molding the valve element (90);

molding the seat (100); and snap fitting the seat to the valve main body over the valve element.

13. The method of claim 12 further comprising:

grinding the valve element.

14. The dispenser of claim 1 wherein:

a cover is snap fit across the annular wall.

15. The dispenser of claim 14 wherein:

the main body is a unitary plastic molding.

16. The dispenser of claim 1 wherein:

the main body is a unitary plastic molding.

17. A dispenser (20) comprising:

a container body (22);

a closure valve assembly (24) comprising:

a seat (100) having an opening (122);

a valve element (90) shiftable between:

an open position depressed clear of the opening; and a closed position closing the opening; and a plurality of radially inwardly directed petals (106) supporting the valve element (90) with flex spring bias toward the closed position; and a cap (28) having:

a closed condition depressing the valve element to the valve element's open position; and an open condition disengaged from the valve element, wherein the closure valve assembly comprises a main body (50) as:

an internally threaded boss (52) receiving an externally threaded neck (36) of the container;

a neck (62) engaging the cap in the closed condition;

a wall (102) within the neck cooperating with the neck to define a channel; and said plurality of petals (106) directed radially inward from the wall.

18. The dispenser of claim 17 wherein:

the main body is a unitarily molded single piece.

19. The dispenser of claim 17 wherein:

the valve element comprises a ball.

20. The dispenser of claim 17 wherein:

a cover is snap fit across the wall.

* * * * *